US009627781B2

(12) United States Patent
Winkler et al.

(10) Patent No.: US 9,627,781 B2
(45) Date of Patent: Apr. 18, 2017

(54) CONTACT ELEMENT AND METHOD FOR MANUFACTURING SAME

(75) Inventors: Peter Winkler, Leonberg (DE); Rainer Maier, Tamm (DE); Gregor Jaehnig, Muehlacker (DE); Bastian Buchholz, Stuttgart (DE); Bernd Rattay, Ditzingen (DE); Jens Schneider, Leonberg (DE); Guido Soyez, Ludwigsburg (DE); Joachim Stier, Bad Liebenzell (DE); Sebastian Russ, Rutesheim (DE); Sascha Klett, Oppenweiler (DE)

(73) Assignee: ROBERT BOSCH GMBH, Stuttgart (DE)

( * ) Notice: Subject to any disclaimer, the term of this patent is extended or adjusted under 35 U.S.C. 154(b) by 29 days.

(21) Appl. No.: 14/004,628

(22) PCT Filed: Feb. 9, 2012

(86) PCT No.: PCT/EP2012/052198

§ 371 (c)(1),
(2), (4) Date: Nov. 14, 2013

(87) PCT Pub. No.: WO2012/123195

PCT Pub. Date: Sep. 20, 2012

(65) Prior Publication Data

US 2014/0060926 A1 Mar. 6, 2014

(30) Foreign Application Priority Data

Mar. 16, 2011 (DE) ..... 10 2011 005 655

(51) Int. Cl.
*H01R 4/48* (2006.01)
*H01R 4/18* (2006.01)
(Continued)

(52) U.S. Cl.
CPC ..... *H01R 4/18* (2013.01); *H01R 13/03* (2013.01); *H01R 13/24* (2013.01); *H01R 43/16* (2013.01);
(Continued)

(58) Field of Classification Search
CPC .. H01R 4/18; H01R 43/0207; H01R 43/0221; H01R 13/03; H01R 43/16; H01R 4/625; H01R 13/26; Y10T 29/49208
(Continued)

(56) References Cited

U.S. PATENT DOCUMENTS 3,233,211 A 2/1966 Smith
3,697,925 A * 10/1972 Henschen ..... 439/494
(Continued)

FOREIGN PATENT DOCUMENTS

DE 14 40 860 3/1969
DE 196 38 208 4/1998
(Continued)

OTHER PUBLICATIONS

International Search Report for PCT/EP2012/052198, dated May 2, 2012.

*Primary Examiner* — Jean F Duverne
(74) *Attorney, Agent, or Firm* — Gerard Messina

(57) ABSTRACT

A contact element for contacting a contact point formed on a body includes: an element section on the contact point side for a force-locking connection to the contact point, an element section on the connection side for connection to an electrical connection conductor, and an intermediate section which connects the two element sections to one another for compensating for thermal expansions. At least the element sections on the contact point side and on the connection side are made of different integrally bonded materials having
(Continued)

material properties which are adapted to the functionality of the corresponding element section.

10 Claims, 3 Drawing Sheets

(51) Int. Cl.

| | |
|---|---|
| ***H01R 13/03*** | (2006.01) |
| ***H01R 13/24*** | (2006.01) |
| ***H01R 43/16*** | (2006.01) |
| *H01R 4/62* | (2006.01) |
| *H01R 13/26* | (2006.01) |
| *H01R 43/02* | (2006.01) |

(52) U.S. Cl.
CPC ..... *H01R 4/625* (2013.01); *H01R 13/26* (2013.01); *H01R 43/0207* (2013.01); *H01R 43/0221* (2013.01); *Y10T 29/49208* (2015.01)

(58) Field of Classification Search
USPC ..... 439/816, 844, 494, 876, 886–88, 853, 439/874
See application file for complete search history.

(56) References Cited

U.S. PATENT DOCUMENTS

| | | | | |
|---|---|---|---|---|
| 3,806,859 | A * | 4/1974 | Madarasz et al. | 439/712 |
| 3,864,004 | A * | 2/1975 | Friend | 439/844 |
| 4,442,182 | A * | 4/1984 | Chart | 428/654 |
| 4,723,923 | A | 2/1988 | Senor et al. | |
| 5,533,915 | A * | 7/1996 | Deans | 439/678 |
| 6,437,276 | B1 | 8/2002 | Bruchmann et al. | |

FOREIGN PATENT DOCUMENTS

| | | | | |
|---|---|---|---|---|
| DE | 102004050715 B3 | 3/2006 | | |
| FR | 918 579 | 2/1947 | | |
| JP | 61-213764 A * | 9/1986 | | 204/431 |
| JP | H 05-54924 | 3/1993 | | |
| JP | 2006-236873 | 9/2006 | | |
| RU | 2213403 C2 | 9/2003 | | |
| RU | 2249872 C2 | 4/2005 | | |
| RU | 60787 U | 1/2007 | | |

* cited by examiner

CONTACT ELEMENT AND METHOD FOR MANUFACTURING SAME

BACKGROUND OF THE INVENTION

1. Field of the Invention

The present invention is directed to a contact element for contacting an electrical contact point designed on a body, in particular a ceramic sensor element of a gas sensor.

2. Description of the Related Art

A known method of electrical contacting of a sensor element of a gas sensor or a gas probe with the electrical conductors of a connecting cable in published German patent document DE 196 38 208 C2 has at least one contact part or contact element which presses in a force-locking manner on one of the contact points formed on the section of the sensor element on the connection side. The contact element has a section, which is on the sensor element side or the contact point side and rests on the contact point with a spring effect, and has a section, which is on the connection side and is connected to an electrical conductor of the connecting cable, and has an arc-shaped intermediate section, which serves to equalize thermal and/or mechanical expansions and movements of the contact element. The contact element is made of nickel or a nickel alloy and the contact point is made of a sintered platinum cermet containing at least 95% platinum.

BRIEF SUMMARY OF THE INVENTION

The contact element according to the present invention has the advantage that the contact element has areas tailored in a function-specific manner which meet the operating requirements already at the time of delivery and installation, e.g., in the gas sensor. This lowers costs while facilitating and improving the assembly. The use of expensive heat-resisting material may thus be limited to the element section near the contact point side, and the element section near the connection side may be manufactured with a lower strength, which in turn facilitates the crimping operation during connection of an electrical conductor of a connecting cable to the contact element, while at the same time reducing wear on the crimping tool. The contact element as a whole is a finished unit, so that during subsequent assembly of the contact element for establishing an electrical contact in a gas sensor, for example, as in the sensor and cable harness assembly, complex processes for connecting the individual element sections are eliminated.

According to one advantageous specific embodiment of the present invention, the element section on the contact point side is made of a heat-resisting alloy according to DIN 10269. Use of these heat-resisting and highly heat-resisting nickel-based alloys ensures a high contact force with a long service life of the contact element.

According to one advantageous specific embodiment of the present invention, the element section on the connection side is made of a corrosion-resistant steel of the 1.43xx family according to DIN 10088, for example, of steel 1.4303. This material has a sufficiently high elongation at break and a low tendency for cold working. It is readily deformable and is therefore very suitable for crimping for the purpose of connecting the element section on the connection side to the electrical conductor of the connecting cable, and it avoids excessive wear on the crimping tool, so that the latter achieves a long tool life. To ensure adequate formability of the end section on the connection side, according to another specific embodiment of the present invention, this material is used in the solution-annealed state.

According to one advantageous specific embodiment of the present invention, the intermediate section is made of a cold-worked, corrosion-resistant steel of the 1.43xx family according to DIN 10088, for example, of steel 1.4310. The ductility of the intermediate section, i.e., its axial spring characteristic, is adjusted through this choice of material, preferably also in combination with a corresponding geometric design of the intermediate section, for example, an expansion arc, in such a way that different thermal expansions of additional components, e.g., in a gas sensor, are compensated for. In a gas sensor, the contact element is connected to a protective metallic sleeve via an electrical conductor of the connecting cable and an elastomer grommet, which expands much more than the sensor element with an increase in temperature. Due to the expansion compensation occurring in the intermediate section, there is no relative movement between the contact point on the sensor element and the contact element, so that an increase in the transitional resistance due to frictional corrosion is suppressed. The cold-worked state, which results in a high yield point of the intermediate section, also offers the advantage that the deformation characteristic remains in the elastic range and thus a cyclic deformation is reversible. Likewise, a cyclic deformation in the intermediate section, which is triggered by vibrations of the contact element, which is only partially accommodated in a contact holder, remains in the elastic range and is thus reversible, so that the contact element—and thus the gas sensor—may be exposed to a higher vibration load.

The method according to the present invention has the advantage that the individual element sections may be tailored to the corresponding functional requirements in a favorable manner in terms of the manufacturing technology. The partially one-piece embodiment of the intermediate section having the element section on the contact point side and the element section on the connection side reduces the number of individual parts to be joined without any mentionable impairment of the adaptation of the intermediate section to the functional requirement of compensation of different thermal expansions. Joining the two individual parts and bonding them integrally provide a finished, complete contact element for subsequent assembly, e.g., the gas sensor, so that complex assembly operations, e.g., during the sensor and cable harness assembly of a gas sensor, are eliminated and assembly costs are significantly reduced.

The method according to the present invention has the advantage that by manufacturing the multimetal band made up of three different metal bands, the contact element may be produced in a single operation by a simple punching/bending operation. In comparison with the composition of the contact element from individual parts representing the various element sections, it is possible to simplify the manufacturing process, which results in a definite reduction in manufacturing costs. However, the provision of three metal bands of different materials and the integral bonding of the three metal bands along their adjacent abutting edges do not reduce the manufacturing complexity as much as would be desirable.

The method according to the present invention has the advantage that, with regard to the choice of materials, by combining the end section on the connection side and the intermediate section, it is possible to manufacture a bimetal band by a single integral bond along the abutting edges of the two metal bands of different materials, and thereby manufacturing costs are further reduced. The embodiment of the intermediate section having the element section on the connection side, made of the same material, does have a somewhat negative effect on the optimal design of the axial spring characteristic of the intermediate section and of its vibrational strength, but both may be compensated for by an adapted geometric shape of the intermediate section. Electron beam welding or laser welding may be used for the joining operation, as in the manufacture of the three-band multifunction band. The requirements of the punching and bending tool, a so-called progressive die tool, are therefore unchanged.

DETAILED DESCRIPTION OF THE INVENTION

Figure 1:
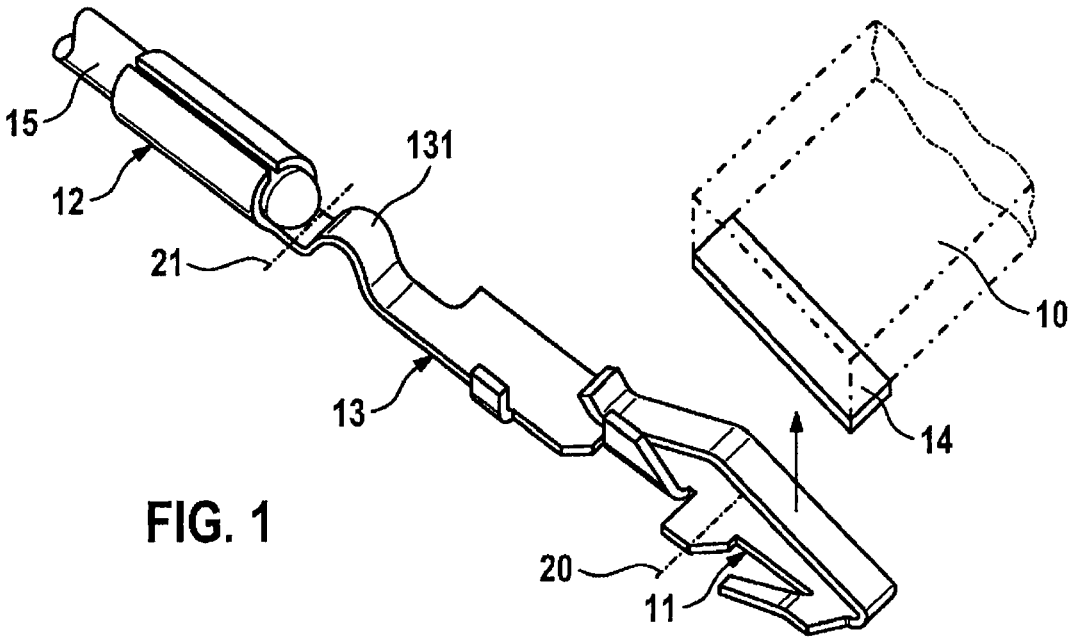
FIG. 1 shows a perspective view of a contact element according to a first exemplary embodiment.

The contact element, which is shown in a perspective view in FIG. 1, for contacting an electrical contact point formed on a body is used for contacting a flat contact point formed on the surface of a ceramic sensor element of a gas sensor, for example. The contact element connects the contact point of the sensor element to an electrical conductor of a connecting cable leading to the gas sensor. Such a gas sensor having a sensor element, a connecting cable and a contact element is described in DE 196 38 208 C2, for example, which was cited at the outset.

The contact element has three element sections, namely an element section 11 on the contact point side for a force-locking contact with the contact point of the body, an element section 12 on the connection side for connection to an electrical connecting conductor and an intermediate section connecting two element sections 11, 12 to one another for equalization of thermal expansions. For the sake of thoroughness, FIG. 1 schematically shows flat contact point 14 formed on body 10, element section 11 on the contact point side being in spring contact with it, and electrical conductor 15 to which element section 12 on the connection side is connected electrically conductively by crimping, for example.

Element section 11 on the contact point side, element section 12 on the connection side and intermediate section 13 are each made of different materials, which are integrally bonded, each having the material properties adapted to the functionality of the corresponding element section. Element section 11 on the contact point side is made of a heat-resisting alloy according to DIN 10269. Such a heat-resisting or highly heat-resisting nickel-based alloy ensures a sufficiently high contact force over the lifetime of the contact element at the high temperatures of more than 400° C. required with gas sensors. Element section 12 on the connection side is made of a corrosion-resistant steel of the 1.43xx family according to DIN 10088, for example, corrosion-resistant steel 1.4303. Such steel has a sufficiently high elongation at break and has a low tendency to strain hardening, so it is readily deformable during crimping for the purpose of connecting element section 12 on the connection side to electrical connecting conductor 15 and it does not generate much tool wear on the crimping tool. To ensure even better formability, the corrosion-resistant steel is used in a solution-annealed state. Solution annealing returns the material to its initial state, so that in addition to the uniform distribution of the alloy components, there is a decline in hardening, so that the material is soft and therefore readily formable. Intermediate section 13 is made of a cold-worked corrosion-resistant steel of the 1.43xx family according to DIN 10088, for example, corrosion-resistant steel 1.4310. Cold working is carried out to ensure a linear characteristic of the ductility of intermediate section 13 and the vibration strength of the contact element. In addition to the choice of materials, intermediate section 13 is designed with a suitable geometry having an arc 131 to improve its ductility, for example, as shown in FIG. 1.

Figure 2:
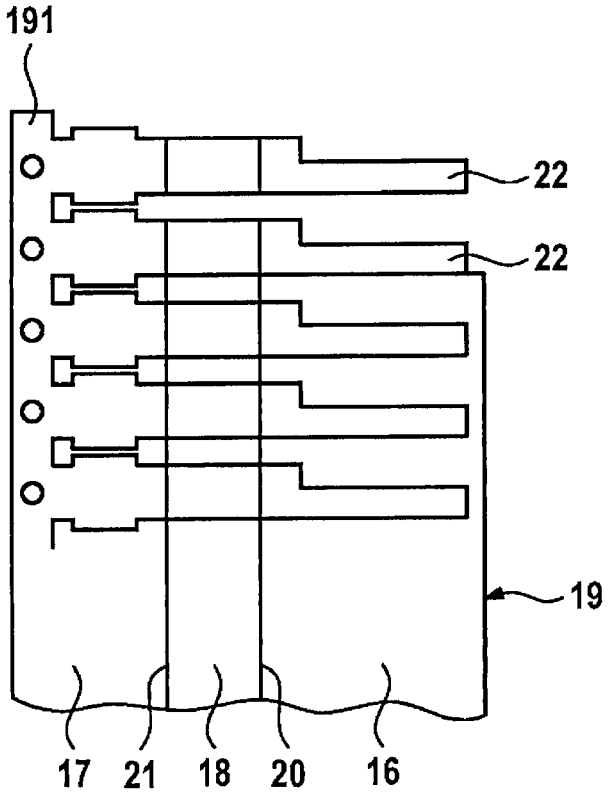
FIG. 2 shows a detail of a top view of a band made up of three metal bands for the punching/bending operation of the contact element in FIG. 1.

To manufacture the contact element, three metal bands 16, 17, 18 made of the aforementioned materials of element section 11 on the contact point side, intermediate section 13 and element section 12 on the connection side are initially placed with their abutting edges next to one another and are integrally bonded butt-to-butt to form a multimetal band 19 (FIG. 2). The integral bond may be established by electron beam welding or laser welding. FIG. 2 shows in a detail a multimetal band 19 made of three metal bands 16, 17, 18 in a top view. Both abutting edges, along which three metal bands 16, 17, 18 are welded to one another, are labeled with reference numerals 20 and 21, abutting edge 20 running between metal bands 16 and 18 and abutting edge 21 running between metal bands 17 and 18. Punched parts 22 having a longitudinal extent running across the abutting edge are then punched out of this multimetal band 19 in such a way that element section 11 on the contact point side emerges from metal band 16, intermediate section 13 emerges from metal band 18 and element section 12 on the connection side emerges from metal band 17.

At the top, FIG. 2 shows a punched part 22 which has been punched out and a multimetal band 19, while additional punched parts 22 are represented as figures in multimetal band 19 but have not yet been punched out. All punched parts 22 are still held together by a perforated band 191 on the left edge of multimetal band 19 for technical reasons relating to the manufacturing, but will be separated later. Together with the punching operation, element section 11 on the contact point side, element section 12 on the connection side and intermediate section 13 are formed on each punched part 22 so that the contact element shown in FIG. 1 is created. FIG. 2 shows punched parts 22 merely schematically, and do not correspond to the geometric shape of the contact element in FIG. 1. With dash-dot lines, FIG. 1 shows abutting edge 20 between element section 11 on the contact point side and intermediate section 13 and abutting edge 21 between intermediate section 13 and element section 12 on the connection side.

Figure 3:
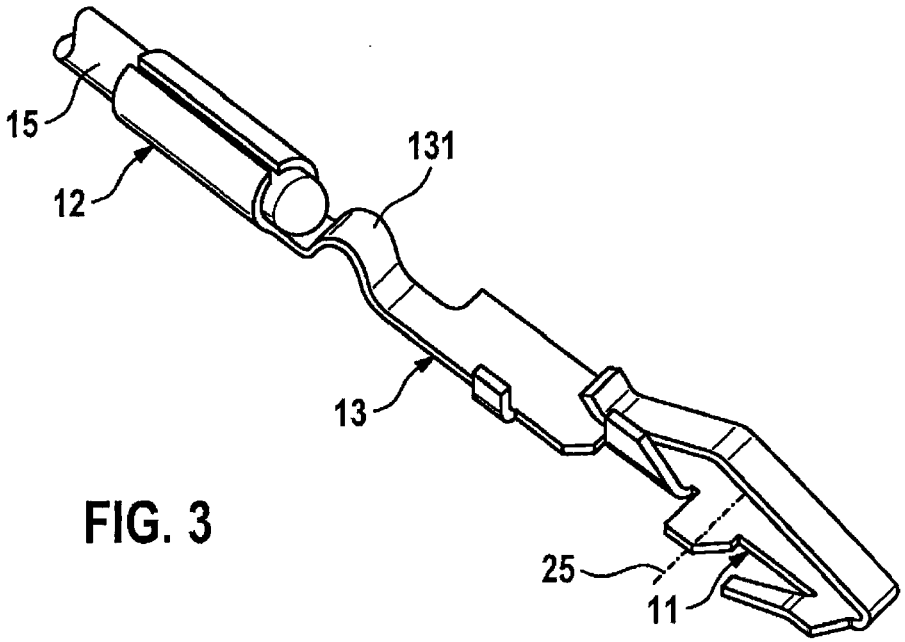
FIG. 3 shows a perspective view of the contact element according to a second exemplary embodiment.

In the contact spring shown in FIG. 3 according to a second exemplary embodiment, element section 11 on the contact point side and element section 12 on the connection side are made of different integrally bonded materials, the properties of the materials again being adapted to the functionality of element sections 11 and 12. Element section 11 on the contact point side, like the same element section in FIG. 1, is again made of a heat-resisting alloy according to DIN 10269. Element section 12 on the connection side is made of a corrosion-resistant steel of the 1.43xx family according to DIN 10088 in the same way as that described in conjunction with FIG. 1.

Unlike the contact element according to FIG. 1, intermediate section 13 is made of the same material as element section 12 on the connection side, i.e., a corrosion-resistant steel of the 1.43xx family according to DIN 10088.

Figure 4:
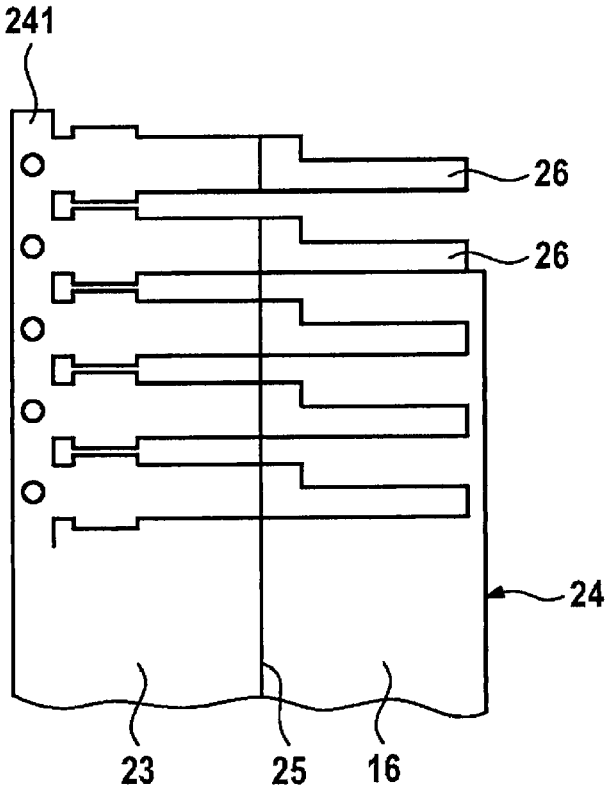
FIG. 4 shows a detail of a top view of a bimetal band made up of two metal bands for the punching/bending operation of the contact element in FIG. 3.

To manufacture the contact element according to FIG. 3, two metal bands 16 and 23 made of the materials of element section 11 on the contact point side and element section 12 on the connection side are initially placed side by side with their longitudinal edges and are integrally bonded butt-to-butt to form a bimetal band 24 (FIG. 4). The joining operation may in turn be carried out by electron beam welding or laser welding. FIG. 4 shows details of bimetal band 24 manufactured in this way in a top view. The abutting edge in bimetal band 24 along which two metal bands 16 and 23 are welded together is shown with reference numeral 25 in FIG. 4.

A punched part 26 having a longitudinal extent running across abutting edge 25 is punched out of bimetal band 24 in such a way that element section 11 on the contact point side emerges from metal band 14 and element section 12 on the connection side together with intermediate section 13 emerges from the other metal band 23. A punched part 26 punched out of bimetal band 24 is shown at the upper edge of bimetal band 24 in FIG. 4. Additional punched parts 26 not yet punched out are shown in their contours in bimetal band 24; they are punched out individually or in groups, depending on the design of the punching tool. Punched parts 26 are separated by subsequently severing edge band 241 running on the left edge of bimetal band 24. Element section 11 on the contact point side, on the one hand, and element section 12 on the connection side are formed together with intermediate section 13, on the other hand, on each punched part 26, preferably simultaneously with the punching operation, thereby yielding the contact element in its shape depicted in FIG. 3. Here again, punched parts 26 are shown schematically and do not have the individual punch contours of the contact spring in FIG. 3. With dash-dot lines, FIG. 3 shows abutting edge 25 running in the contact spring, along which the different materials are integrally bonded.

Figure 5:
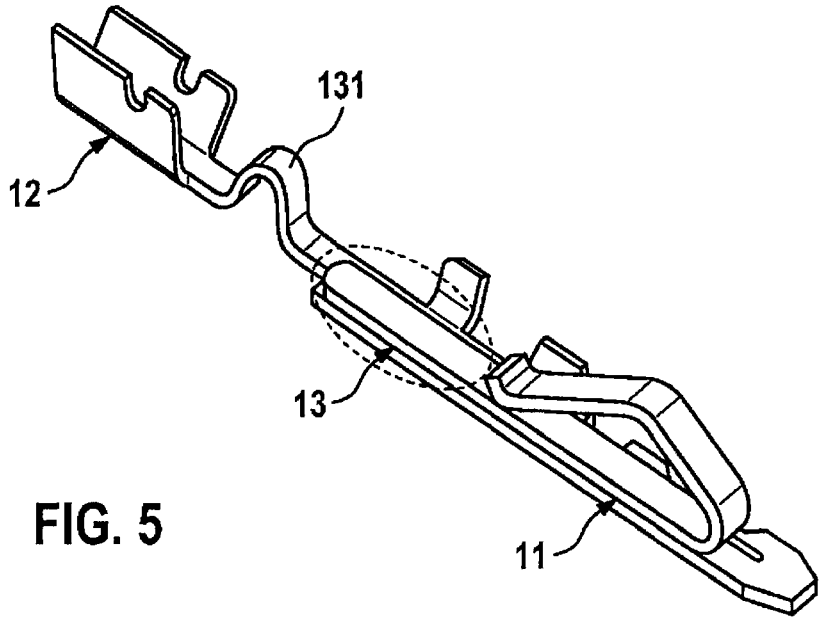
FIG. 5 shows a perspective top view of the contact element according to a third exemplary embodiment.
Figure 6:
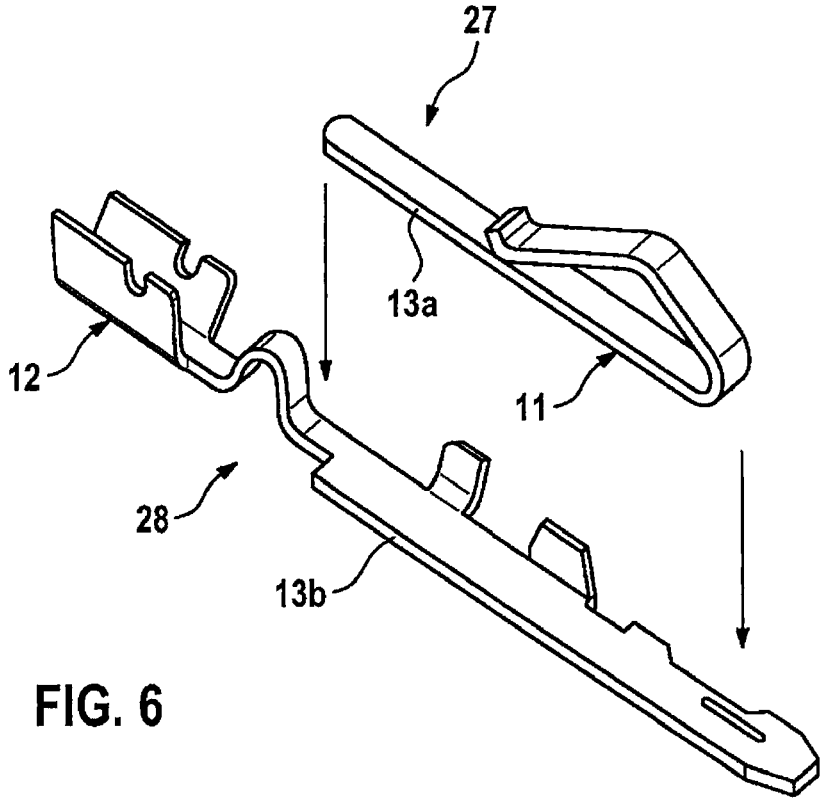
FIG. 6 shows a perspective diagram of individual pieces of the contact element in FIG. 5 before being joined.

The contact element shown in FIG. 5 according to a third exemplary embodiment in turn has element section 11 on the contact point side, element section 12 on the connection side and intermediate section 13. However, unlike the preceding exemplary embodiments, element section 11 on the contact point side and element section 12 on the connection side form separate element pieces 27 and 28 (FIG. 6). Intermediate section 13 is at least partially in one piece with at least one of two element sections 11, 12, i.e., it is made of the same material. Two element pieces 27, 28 are integrally bonded in area 29 of intermediate section 13 to form a preassembled integrated unit. Connecting area 29 is indicated schematically by a broken line in FIG. 5.

As in the exemplary embodiments in FIGS. 1 and 2, element sections 11, 12 are made of different materials, whose properties are adapted to the functionality of element section 11 on the contact point side and of element section 12 on the connection side. Element section 11 on the contact point side is in turn made of a heat-resisting alloy according to DIN 10269; element section 12 on the connection side is made of a corrosion-resistant steel of the 1.43xx family according to DIN 10088. Intermediate section 13 is made in part of the same material as element section 11 on the contact point side and in part of the same material as element section 12 on the connection side. These parts 13*a* and 13*b* of intermediate section 13 are integrally bonded in area 29, the integral bond being established by an electron beam or laser welding operation.

To manufacture element section 11 on the contact point side according to FIG. 5, element section 11 on the contact point side, on the one hand, and element section 12 on the connection side, on the other hand, are initially each punched and bent together with a part 13*a* and 13*b* of intermediate section 13 as separate element parts 27, 28 (FIG. 6). Two separate element parts 27, 28 are subsequently joined as indicated by dashed lines in FIG. 6 and are integrally bonded in area 29 of intermediate section 13.

What is claimed is:

1. A contact element for contacting an electrical contact point formed on a body, comprising:

a first element section on a contact point side for forming a force-locking contact with the electrical contact point;

a second element section on a connection side for connection to an electrical connecting conductor; and an intermediate section connecting the first and second element sections to one another for equalizing thermal expansions;

wherein at least the first element section on the contact point side and the second element section on the connection side are made of different integrally bonded materials having material properties which are adapted to the respective functionalities of the first and second element sections; and wherein the first element section on the contact point side is made of a heat-resisting material.

2. The contact element as recited in claim 1, wherein the heat-resisting material used to make the first element section on the contact point side is a heat-resisting alloy according to DIN 10269.

3. The contact element as recited in claim 2, wherein the second element section on the connection side is made of a corrosion-resistant steel of the 1.43xx family according to DIN 10088.

4. The contact element as recited in claim 3, wherein the corrosion-resistant steel is in a solution-annealed state.

5. The contact element as recited in claim 3, wherein the intermediate section is made of a cold-worked corrosion-resistant steel of the 1.43xx family according to DIN 10088.

6. The contact element as recited in claim 1, wherein the intermediate section is made of the same material as at least one of the first end section on the contact point side and the second end section on the connection side.

7. The contact element as recited in claim 6, wherein the first element section on the contact point side and the second element section on the connection side are formed in separate element parts, and wherein at least a portion of the intermediate section is configured as a part of a unitary piece also including at least one of the first and second element sections, and wherein the first and second element parts are joined and integrally bonded in an area of the intermediate section to form a preassembled unit.

8. A method for manufacturing a contact element for contacting an electrical contact point formed on a body, the contact element having: a first element section on a contact point side for forming a force-locking contact with the electrical contact point; a second element section on a connection side for connection to an electrical connecting conductor; and an intermediate section connecting the first and second element sections to one another for equalizing thermal expansions; wherein at least the first element section on the contact point side and the second element section on the connection side are made of different integrally bonded materials having material properties which are adapted to the respective functionalities of the first and second element sections, and wherein the first element section on the contact point side and the second element section on the connection side are formed in separate element parts, the method comprising:

forming a first unitary piece by punching and bending, wherein the first unitary piece includes the first element section on the contact point side and a portion of the intermediate section;

forming a second unitary piece by punching and bending, wherein the second unitary piece includes the second element section on the connection side and a portion of the intermediate section; and joining and integrally bonding the first and second unitary pieces in an area of the intermediate section.

9. A method for manufacturing a contact element for contacting an electrical contact point formed on a body, the contact element having: a first element section on a contact point side for forming a force-locking contact with the electrical contact point; a second element section on a connection side for connection to an electrical connecting conductor; and an intermediate section connecting the first and second element sections to one another for equalizing thermal expansions; wherein at least the first element section on the contact point side and the second element section on the connection side are made of different integrally bonded materials having material properties which are adapted to the respective functionalities of the first and second element sections, the method comprising:

integrally bonding a first metal band and a second metal band side-by-side at an abutting edge to form a bimetal band, wherein the first metal band is made of the materials of the first element section on the contact point side and the second metal band is made of the materials of the second element section on the connection side; and punching out a punched part having a length extending laterally across the abutting edge of the bimetal band, wherein the first element section on the contact point side emerges from the first metal band portion of the punched part, and wherein the second element section on the connection side and the intermediate section emerge from the second metal band portion of the punched part.

10. A method for manufacturing a contact element for contacting an electrical contact point formed on a body, the contact element having: a first element section on a contact point side for forming a force-locking contact with the electrical contact point; a second element section on a connection side for connection to an electrical connecting conductor; and an intermediate section connecting the first and second element sections to one another for equalizing thermal expansions; wherein at least the first element section on the contact point side and the second element section on the connection side are made of different integrally bonded materials having material properties which are adapted to the respective functionalities of the first and second element sections, the method comprising:

integrally bonding (i) a first metal band to a first abutting edge of a second metal band and (ii) a third metal band to a second abutting edge of the second metal band to form a multi-metal band, wherein the first metal band is made of the materials of the first element section on the contact point side, the second metal band is made of materials of the intermediate section, and the third metal band is made of the materials of the second element section on the connection side; and punching out a punched part having a length extending laterally across the first and second abutting edges of the multi-metal band, wherein the first element section on the contact point side emerges from the first metal band portion of the punched part, the intermediate section emerges from the second metal band portion of the punched part, and the second element section on the connection side emerges from third metal band portion of the punched part.

* * * * *